US005535807A

United States Patent [19]

Cattaneo

[11] Patent Number: 5,535,807

[45] Date of Patent: Jul. 16, 1996

[54] ELEMENT FOR THE CONNECTION OF LIFT STRAPS OF ROLLING SHUTTERS

[75] Inventor: Rino Cattaneo, Mezzago, Italy

[73] Assignee: I.M.B.A.C. S.p.A., Milan, Italy

[21] Appl. No.: 347,059

[22] Filed: Nov. 30, 1994

[30] Foreign Application Priority Data

Mar. 7, 1994 [IT] Italy ..... MI940160 U

[51] Int. Cl.[6] ..... E06B 9/56

[52] U.S. Cl. ..... 160/319; 160/323.1

[58] Field of Search ..... 160/319, 321, 160/323.1, 307, 308, 23.1, 133, 383, 400, 403, 404, 313

[56] References Cited

U.S. PATENT DOCUMENTS 1,824,673 9/1931 Lee ..... 160/319

4,492,261 1/1985 Chong ..... 160/319

4,883,109 11/1989 Sonderby ..... 160/319 X

*Primary Examiner*—David M. Purol

*Attorney, Agent, or Firm*—Abelman, Frayne & Schwab

[57] ABSTRACT

An improved element for the connection of lift straps (28) of rolling shutters, placed in a container (12) provided with a lid (14), is constituted by a semirigid sheet with a quadrangular back portion (18) and a "T"-shaped front extension (20). The back portion (18) meets the wall (22) of a tongue (24) which extends towards the inside of container (12), while the "T"-shaped extension (20) protrudes from the container through an opening (26), approaching its perimeter surface. The "T"-extension (20) is hand-inserted into a slot (30) provided at the end (28') of the lift strap (28); the vertical branch (20') of the "T"-extension (20) is positioned under the end (28') and fits through the width of opening (26).

9 Claims, 1 Drawing Sheet

ELEMENT FOR THE CONNECTION OF LIFT STRAPS OF ROLLING SHUTTERS

BACKGROUND OF THE INVENTION

FIELD OF THE INVENTION

This invention relates to an improved element for the connection of lift straps of rolling shutters. More particularly, this invention relates to an improved element which allows the quick and stable connection of lift straps of rolling shutters or rolling blinds to the cylindrical core or drum constituted by a container and a lid and containing the loadable spring.

DESCRIPTION OF THE PRIOR ART

As is known, the hand-control of rolling blinds which form the external shutter of windows and French-windows is obtained through a lift strap which causes the rotation of the roller on which the shutter is wound or has to be wound. The lift strap is connected at one end with a pulley, integral with said roller, and around which it has to be wound when the shutter is lowered. At the opposing end, the lift strap is connected to the perimeter band of the drum incorporating the spring, rotating on the frame integrated in the shutter side or applied externally to it.

Generally, such connection is obtained with means such as, for instance, a screw, a rivet or the like, which protrude markedly from the perimeter band of the drum on which they are fastened. This type of connection involves a serious drawback, due to the fact that it alters the linear winding of the lift strap on the drum. In fact, the lift strap superposes on the protruding part of the connection means, and consequently does not adhere perfectly to all the perimeter band of the drum, forming instead a marked localized swelling. The defect intensifies markedly following the superposition of the coils which form because of the progressive winding of the lift strap; as a consequence, once the winding is complete, one has an irregular bobbin, ovalized or at least locally bulging even markedly.

The eccentricity prejudices the subsequent unwinding of the lift strap and the exact containment of the bobbin placed in the frame to which the drum is connected. Besides, the bulging of the restraint means, however dull, may give rise to marked frictional phenomena affecting the subsequent portion of lift strap which winds round the drum, causing in the long run the localized settling of said lift strap and requiring therefore its total replacement. The object of this invention is to obviate the aformentioned drawbacks.

SUMMARY OF THE INVENTION

More particularly, the object of this invention is to provide an improved element particularly suitable for hooking lift straps of rolling shutters to the drum incorporating the spring, which can be integrated in the winding of said lift strap, without causing alterations or deformations in the circular development.

A further object of this invention is to provide an improved element particularly suitable for the hooking of lift straps of rolling shutters to the drum incorporating the spring, such as to allow the prevention of frictional phenomena which may in the long run affect the resistance and strength of the lift strap.

A further object of this invention is to provide users with an improved element for hooking the lift strap to the drum incoporating the spring, which element can be easily and economically realized and assembled.

According to this invention, these and still other objects which will be stressed by the following description can be achieved by the improved element for the connection of lift straps of rolling shutters, made from metal or other suitable materials, which is partly integrated peripherally to the inner surface of the container or drum provided with a lid and a central hole incorporating the preloadable spring, protrudes from it through a radial opening and has its front end tangentially aligned with the external perimeter band of said container.

The structural and functional characteristics of the improved element for the connection of lift straps of rolling shutters to the drum incorporating the spring which is the subject matter of this invention shall be clearly stated by the following detailed description, wherein reference is made to the drawing attached, which shows a preferred embodiment, given by way of non-limiting example.

DESCRIPTION OF THE PREFERRED EMBODIMENT

Figure 1:
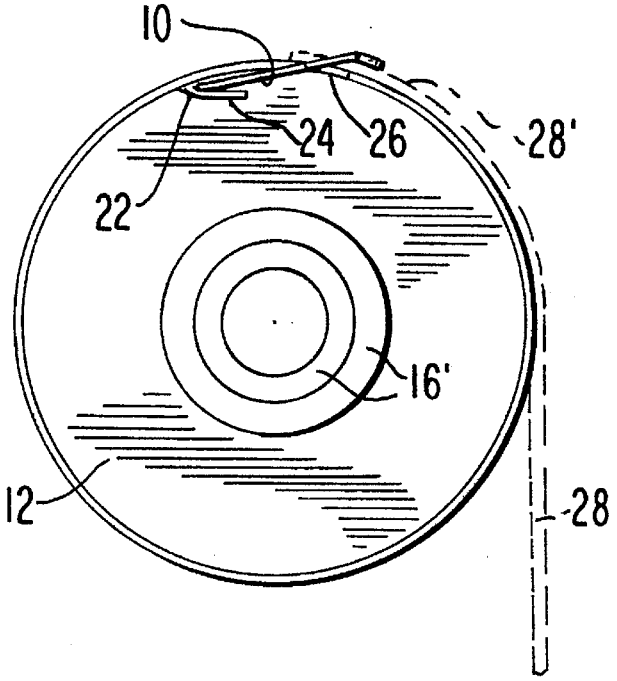
FIG. 1 shows a schematic downwards view of an open drum, with the element for hooking the lift strap housed in it.
Figure 2:
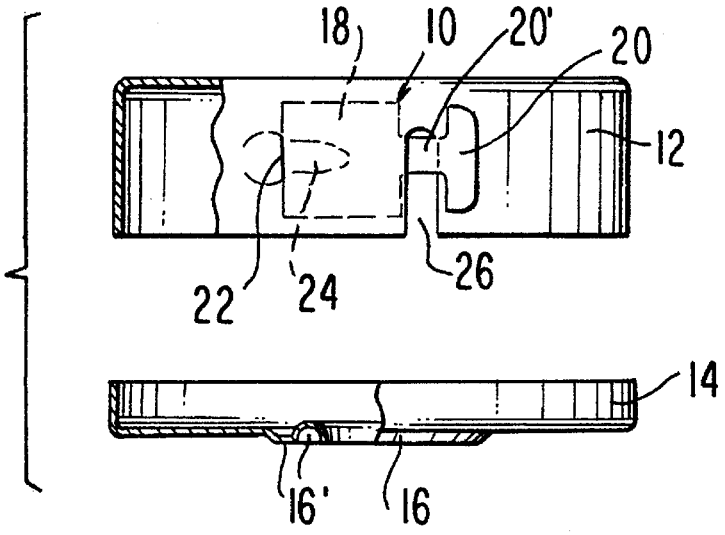
FIG. 2 shows a schematic side view of the drum of FIG. 1 with the associated closing lid.

Beginning with reference to FIGS. 1 and 2, the improved element for the connection of lift straps of rolling shutters, the subject matter of this invention, indicated by 10, is placed in a cylindrical container (12) having a limited height to which a closing lid (14) is associated. Said container (12) and lid (14) are centrally provided with a hole (16), circumscribed preferably by concentric ribs (16'), which houses the pin or shaft (not represented) to which an end of a conventional preloadable spring is connected. The same pin, protruding from the opposite sides of container (12) and lid (14) is connected to a generic support or frame (not represented) applied to the shutter.

According to this invention, the improved element (10) for the connection of the lift strap comprises a very thin semirigid sheet, preferably from metal, whose back portion (18) has preferably a quadrangular development. On the front side, the sheet (10) is provided with a "T"- or mushroom-shaped extension (20), integral with the back portion (18) by means of the vertical portion. Said back portion (18) is housed in a container (12) and meets the bottom wall (22) of a tongue (24), obtained by partial cutting along the perimeter band of the container, which tongue protrudes towards the inside of said container (12). The "T"-shaped extension (20) of element (10) protrudes from the container (12) through an opening (26) obtained starting from the edge on which cover (14) is fitted. Said opening has a width equal or smaller than the vertical branch (20') of the "T"-shaped extension (20) and a depth slightly greater than half the height of the perimeter band of the container (12).

The aforementioned extension (20) on the whole is slightly bent downwards to approach and adhere to the external surface of the perimeter band of the container (12). The back portion (18) of element (10) may possibly be arched in the same way, to follow the circular shape of said container (12).

Figure 3:
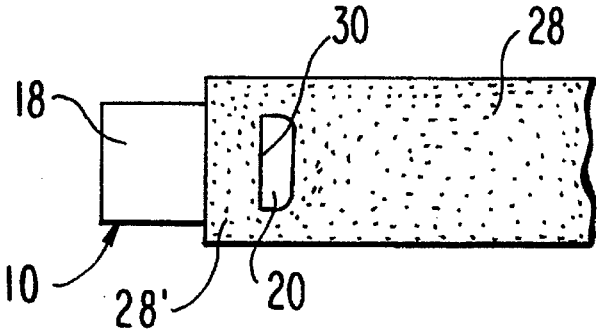
FIG. 3 shows a schematic view of the end portion of the lift strap, to which the element is connected which causes its connection to the drum.

The "T"-shaped extension (20) of element (10) constitutes the means for the connection of a conventional lift strap (28) to the core or drum circumscribed by the cylindrical container (12) closed by lid (14) and wherein the preloadable spring is located. As represented in detail on FIG. 3, the lift strap (28) is provided with an axial slot (30), of limited extension, at its end (28') to be connected to the container (12). The "T"-shaped extension (20) is hand-inserted by rotation in said slot (30), to hook the lift strap (28). The horizontal portion of said extension (20) remains on view above the surface of end (28') of the lift strap (28), while the vertical portion (20') of said extension slightly widens slot (30) and is positioned under said end (28'). Once the connection has been realized, the portion on view of the "T"-shaped extension (20), suitably bent according to the direction of the container (12), overlaps the lift strap (28), adhering to it; the subsequent windings, given the small thickness of said extension, overlap without causing irregularities due to swellings. The connecting element (10) as a whole remains exactly housed in the container (12), meeting with the vertical branch (20') of the "T"-shaped extension (20) the width of opening (26), and being locked, on a perpendicular side, by lid (14) which attaches close to a side of the quadrangular back portion (18).

As can be inferred from the above, the advantages which the connection element subject matter of this invention achieves are evident. Actually, it allows the quick and efficacious connection of the lift strap to the drum incorporating the preloadable spring, without forming swellings which may lead to irregularities in the subsequent windings of the coils. The only portion protruding above the back end of the lift strap is perfectly flat, very thin, and does not cause dangerous friction which might weaken the superposed portion of said lift strap. This invention has been described with reference to a preferred embodiment given by way of non-limiting example, being understood therefore that the connection element may undergo many changes and variants, all of them falling within the protective scope of the invention.

For instance, the configuration and the development of the connection element in the inside of the container, as well as the configuration and the development of the connection element in the part protruding from the container may be different from what has been described and illustrated by way of example. Besides, the tongue which extends towards the inside of the container may be differently shaped and/or extended to house also the end of the preloadable spring, opposite to the one integral with the central pin or shaft. Also structural inversions or different locations of the components which form together the improved element subject matter of this invention are possible.

I claim:

1. Improved semirigid element (10) for the connection of lift straps of rolling shutters to a drum, said drum comprising a cylindrical container (12) having a perimeter band with an internal cylindrical surface and an external cylindrical surface and a lid (14) containing a preloaded spring, said lid being fitted on an edge of said container, characterized in that said improved semirigid element (10) is partly contained within said internal cylindrical surface of said perimeter band of said container (12), protrudes from said container through a radial opening (26) and has its front end tangentially aligned with said external cylindrical surface of said perimeter band of said container.

2. Improved semirigid element according to claim 1, characterized in that said front end is comprised of a "T"-shaped extension (20) connected to a back quadrangular portion (18) by means of a vertical portion (20'), said back portion (18) being housed inside said container (12).

3. Improved semirigid element according to claim 2, wherein the back quadrangular portion (18) meets a bottom wall (22) of a tongue (24) obtained by partial cutting along said perimeter band of said container (12).

4. Improved semirigid element according to claim 3, characterized in that at least part of the "T"-shaped extension (20) is bent in the direction of said perimeter band of said container (12).

5. Improved semirigid element according to claim 4, characterized in that a vertical portion (20') of the "T"-shaped extension (20) is fitted through the width of an opening (26) in said container (12) starting from said edge of said container.

6. Improved semirigid element according to claim 5, characterized in that said opening (26) has a width equal or smaller than the vertical portion (20') of the "T"-shaped extension (20) and a depth slightly greater than half the height of the perimeter band of said container (12).

7. Improved semirigid element according to claim 2, characterized in that the back portion (18) is arched and substantially parallel to the internal cylindrical surface of the perimeter band of said container (12).

8. Improved semirigid element according to claim 5, wherein an end (28') of a lift strap (28) to be connected to said container (12) is provided with a radial slot (30); the "T"-shaped extension (20) being inserted in said slot (30), so that its horizontal portion remains on view above the surface of the lift strap (28) and the vertical portion (20') of the "T"-shaped extension (20) slightly widens said slot (30) and locates under the lift strap (28).

9. Improved semirigid element according to claim 1, characterized in that said "T"-shaped extension (20) fits with its vertical portion (20') through the width of said opening (26) and is locked on by said lid (14) of said container (12), said lid being fitted onto said container close to a side of the back portion.

* * * * *